US006044992A

United States Patent [19]

Ma

[11] Patent Number: 6,044,992

[45] Date of Patent: Apr. 4, 2000

[54] RATCHETS FOR BOTTLE NECKS

[75] Inventor: Xiaoli Ma, San Jose, Calif.

[73] Assignee: Portola Packaging, Inc., San Jose, Calif.

[21] Appl. No.: 09/090,304

[22] Filed: Jun. 3, 1998

[51] Int. Cl.[7] ..... B65D 7/28

[52] U.S. Cl. ..... 215/44; 215/252

[58] Field of Search ..... 215/43, 44, 252, 215/256, 258, 330

[56] References Cited

U.S. PATENT DOCUMENTS

| | | | |
|---|---|---|---|
| 4,830,207 | 5/1989 | Battegazzore | 215/252 |
| 5,115,932 | 5/1992 | Schneider | 215/252 |

FOREIGN PATENT DOCUMENTS

| | | | |
|---|---|---|---|
| 2047916 | 2/1992 | Canada | 215/258 |
| 8190 | 2/1980 | European Pat. Off. | 215/252 |

*Primary Examiner*—Allan N. Shoap
*Assistant Examiner*—Joe Merek
*Attorney, Agent, or Firm*—Julian Caplan, Esq.; Flehr Hohbach Test Albritton & Herbert

[57] ABSTRACT

Bottle necks for screw-off caps are provided with external threads to mesh with internal cap threads and external ratchet teeth to engage internal cap ratchet teeth. When the neck is formed of a rigid material (e.g., PET), the sharp corners of the intersecting flanks of the teeth are hazardous. To reduce the chance of injury, in accordance with this invention the corners are rounded off in a radius having its center offset from the intersection of the working flank of the tooth and the minor ratchet diameter without detrimentally reducing the length of the working flanks. Ratchet teeth are usually located in one of two diametrically disposed quadrants. The first or transition tooth of each quadrant has a greater radius than that of subsequent teeth and its center is inset toward the neck axis. In advance of the first or transition tooth is a protective "tooth" which is rounded and has no working flank, which tends to deflect the fingers of the user away from the subsequent teeth, for reducing the chance of injury.

11 Claims, 2 Drawing Sheets

RATCHETS FOR BOTTLE NECKS

BACKGROUND OF THE INVENTION

1. Field of the Invention

This invention relates to a new and improved ratchet tooth construction for bottle necks. More particularly the invention relates to the structure of ratchet teeth formed of a hard material. Such bottle neck ratchet teeth interengage ratchet teeth on the interior of a tamper evident band on a bottle cap.

2. Description of Related Art

Bottle neck ratchet teeth to interengage corresponding teeth on a tamper evident band of a bottle cap are well known in the art. Heretofore most bottle necks have been formed of a high density polyethylene material which, from the nature of the molding process, makes the edges of the teeth rounded or blunt. However, with the introduction of injection molded teeth of PET and other hard materials, the intersections of the flanks of ratchet teeth have resulted in sharp corners which are hazardous. The present invention is distinguished from prior tooth shapes in respects hereinafter set forth.

SUMMARY OF THE INVENTION

The bottle neck of the present invention is preferably formed as an injection molded insert of a rigid material such as PET (polyethylene phthalate) or polyvinyl chloride or polycarbonates and the like. Because of the rigidity of the material and the fact that injection molding of the neck insert makes for high definition, the injected surfaces tend to be sharp and can injure the user.

Accordingly, the corner where the working flank of the ratchet tooth and the buttress flank intersect has been rounded in an arc to preserve a sufficient surface of the working flank of the tooth to perform its function and yet to round the corner sufficiently to prevent injury. Accordingly the intersection of the arc with the working flank of the tooth is at a radial point less than the major radius of the tooth. Thus the curved major radius of the tooth protects the user from being cut by the corner where the arc intersects the working flank.

It will be understood that it is common to form the ratchet teeth on a bottle neck in two quadrants diametrically spaced apart. In accordance with the present invention, what would ordinarily be considered the first tooth is replaced with a rounded projection or protector which tends to direct the fingers of the user away from the subsequent teeth and thus further reduce likelihood of injury. The intermediate tooth between the protector and the first regular ratchet tooth is formed smaller than the subsequent ratchet teeth and thus acts as a bridge between the protector and the first ratchet tooth, further tending to direct the fingers away from the teeth which are subsequently encountered as the user twists his hand around the neck of the bottle.

The ratchet teeth are formed with corners rounded off in an arc, the radius of which has its center offset from the intersection of the working flank of the tooth and the minor ratchet diameter without detrimentally reducing the length of the working flank.

DESCRIPTION OF PREFERRED EMBODIMENT

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The neck insert "described herein is formed of a rigid material such as PET. Ordinarily the neck is formed as an injection molded part which is placed in a blow molded die, the remainder of the bottle being blow molded below the neck insert. By reason of the material of construction and the injection molding process, dimensions and corners of the insert" tend to be more precise than those of high density polyethylene blow molded products and hence the sharp corners or ratchet teeth tend to injure the user. The present invention eliminates such dangerous sharp corners.

Figure 2:
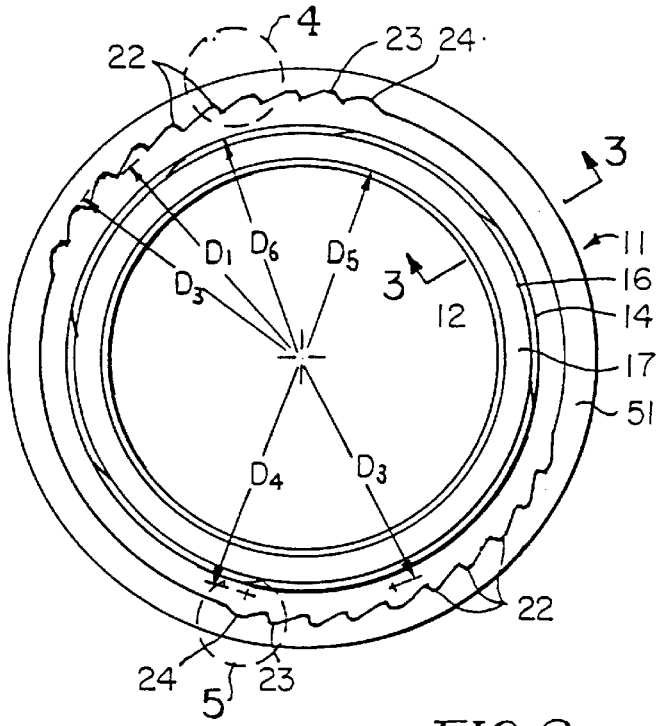
FIG. 2 is a top plan view thereof.
Figure 1:
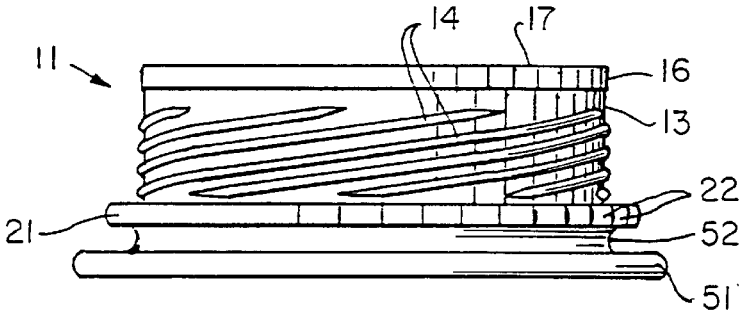
FIG. 1 is a side elevational view of a neck insert in accordance with the present invention.
Figure 3:
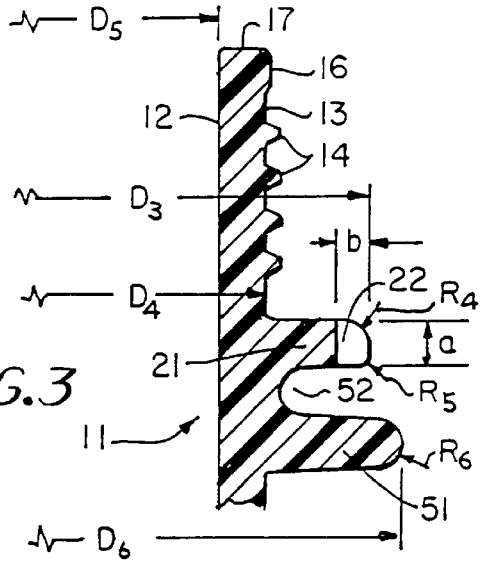
FIG. 3 is an enlarged fragmentary vertical sectional view taken substantially along the line 3–3 of FIG. 2.

As shown in FIGS. 1 through 3 inclusive, neck insert 11 has a smooth generally vertical inside surface 12. The outside surface 13 is formed with external threads 14 which mate with internal threads (not shown) of the cap which closes the neck 11. The threads 14 are subject to some variation. A preferred thread has eight equally spaced starts or leads formed at a pitch of sixteen threads per inch, each thread comprising about 145° of arc. It will be understood that the thread dimensions and the number of threads is subject to considerable variation. Above threads 14 is an enlarged outside diameter portion 16 which results in the lip 17 being slightly wider than the distance between the surfaces 12 and 13 to engage the interior of the cap and form a tight seal with a hollow plug on the underside of the cap and the wall of the upper portion of the interior of the cap skirt.

Spaced downwardly from lip 17 below the threads 14 is an external ratchet ring 21 formed in quadrants which are diametrically opposed (see FIG. 2). Each quadrant has approximately ten ratchet teeth of which the last eight teeth 22 are identical. The first "tooth" actually is a protector 24 and there is an intermediate tooth 23 which is somewhat smaller than teeth 22 between protector 24 and the teeth 22.

Figure 4:
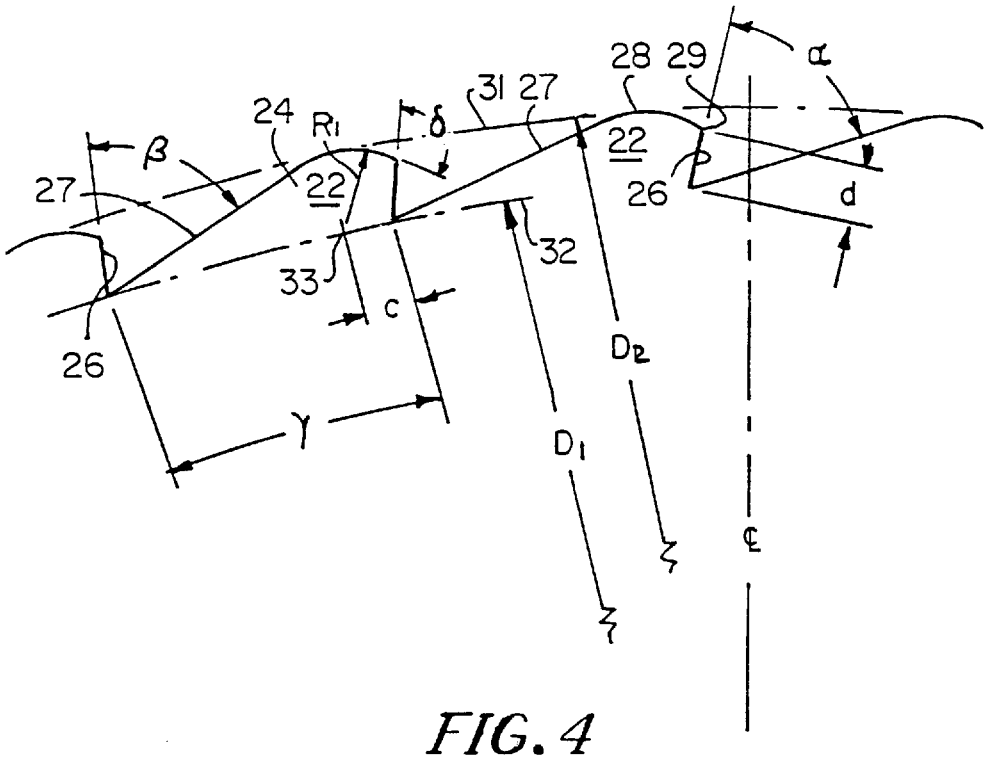
FIG. 4 is a further enlarged schematic view of the ratchet teeth as shown in the circle marked "4" in FIG. 2.

Directing attention to FIG. 4, the shape of most of the ratchet teeth 22 is illustrated schematically. Each tooth 22 has a working flank 26 which engages the corresponding working flank of the ratchet of the cap and, at an angle alpha thereto is the buttress flank 27 of the tooth. As is apparent from FIG. 4, if the flanks 27 and 26 were continued to their intersection, a sharp corner would result. However, in accordance with the present invention, each tooth 22 is formed with an arc or a curved edge 28 which is preferably approximately tangent to flank 27 at one end and intersects flank 26 at a corner 29 at its opposite end.

Arc 28 is also tangent to the major ratchet diameter 31 and it will be noted that the corner 29 is inset from the arc 31, thereby reducing the likelihood of injury to the user. Curved edge 28 is preferably a circular arc having its center at 33. Such center is offset from the intersection of working flank 26 and the buttress flank of the next tooth by a distance marked "c" on FIG. 4. It will further be noted that the working flank 26 is at an angle marked delta in FIG. 4 to a tangent to the arc or curved surface 28 at corner 29. The angle delta is somewhat greater than 90° and less than 180°. As illustrated, the working flanks 26 and buttress flanks 27 intersect. It will be understood, however, that by increasing the angle between teeth, there may be a space between the intersections of the flanks 26 and 27 with the minor ratchet diameter.

Figure 5:
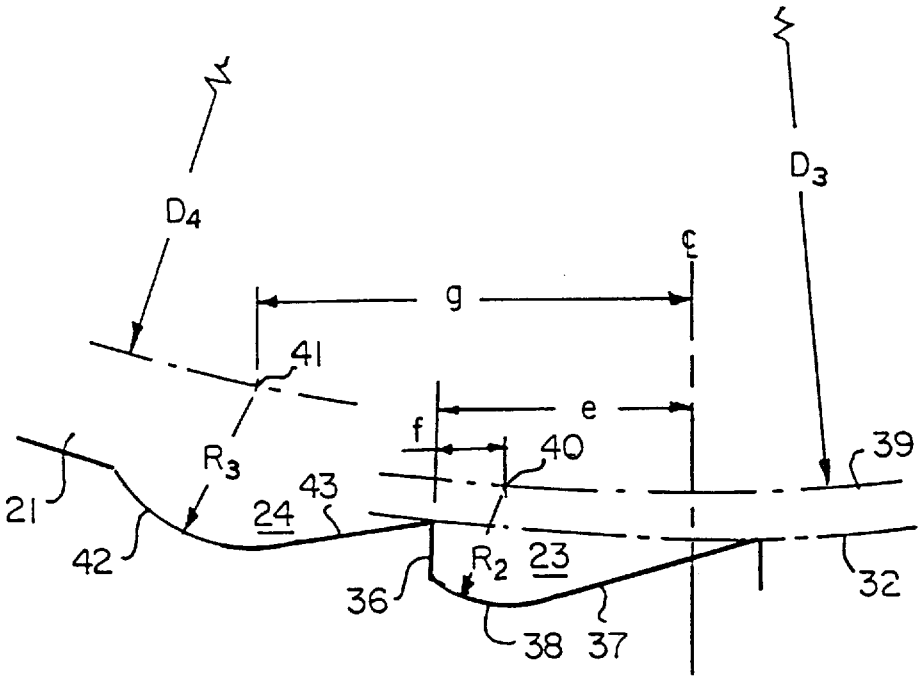
FIG. 5 is a further enlarged schematic view of the protector and intermediate ratchet tooth as shown in the circle marked "5" in FIG. 2.

Directing attention now to FIG. 5, it will be noted that the intermediate tooth 23 is smaller than the teeth 22 of FIG. 4. Arc or curved edge 38 which corresponds to the curved edge 28 of the teeth of FIG. 4 has the center 40 of its radius of curvature $R_2$ located on a diameter $D_3$ or 29 which is substantially less than the diameter $D_1$ or 32 on which center 33 is located. Tooth 23 has a working flank 36, buttress 37 and curved edge 38 which resemble the corresponding reference numerals 25, 27 and 28 of tooth 22.

Further referring to FIG. 4, it will be seen that in advance of intermediate tooth 23 is a protector 24 which has no working surface and comprises an arc 42 having its center 41 on a diameter $D_4$ which is substantially less than the diameter $D_3$. Arc 42 is tangent to the buttress flank 43 of protector 24.

The effects of protector 24 and intermediate tooth 23 are that in the normal course of events the finger or hand of the user will normally first engage the protector 24, which has no sharp corners, and be directed outwardly away from the ratchet ring 21. The effect of intermediate tooth 23 being smaller than the teeth 22 is to further prevent the hand or fingers of the user from being damaged by the subsequent ratchet teeth 22.

Turning now to FIG. 3, it will be seen that viewed in vertical section the upper and lower outer corners of the ring 31 are formed with curved corners or radii $R_4$ and $R_5$ which further reduce the likelihood of injury to the user.

Below ratchet ring 21 is a gripper ring 51 which has a larger diameter than the ratchet ring 21. There is a groove 52 between ring 21 and ring 51 into which a tool may be inserted in order to handle the neck insert 11 and transport it from a chute to the blow molding dies which form the bottle. The gripper ring 51 is also used in loading and filling the bottle as well understood in the art.

The dimensions of the various diameters, radii and distances as well as the angles alpha, beta, gamma and delta which appear in FIGS. 4 and 5 are subject to variation but are generally in the proportions shown in the following table of angles and lengths. The dimensions given are in inches. As has been stated, there may be reasonable variations in the dimensions and in the proportions of the various dimensions, all in accordance with the present invention. The dimensions and angles set forth in the table below are typical for a 38 m in finish. It will be understood that these dimensions and angles would vary accordingly for other size finishes.

TABLE OF ANGLES AND LENGTHS

| | | |
|---|---|---|
| α | angle between flanks | 30°~80° |
| β | angle flank to radius | 50°~80° |
| γ | angle between teeth | 6°~15° |
| δ | angle between tangent to curvature and working flank | 90°~180° |
| $D_1$ | major ratchet diameter | 1.562 |

-continued

TABLE OF ANGLES AND LENGTHS

| | | |
|---|---|---|
| $D_2$ | minor ratchet diameter | 1.500 |
| $D_3$ | OD of ratchet ring | 1.562 |
| $D_4$ | OD of neck | 1.304 |
| $D_5$ | ID of neck | 1.170 |
| $D_6$ | OD of gripper ring | 1.678 |
| $R_1$ | curvature of flank of tooth | 0.020 min. |
| $R_2$ | curvature of transition tooth | 0.044 |
| $R_3$ | curvature of protector tooth | 0.060 |
| $R_4$ | radius of top ring corner | 0.025 |
| $R_5$ | radius of bottom ring corner | 0.060 |
| $R_6$ | radius of gripper ring | 0.035 |
| a | .065 | |
| b | .062 | |
| c | .017 | |
| d | .023 | |
| e | .044 | |
| f | .017 | |
| g | .157 | |

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A neck finish comprising a threaded upper neck portion and a ratchet ring below said upper neck portion, said ratchet ring being formed with a plurality of ratchet teeth, at least one said tooth when viewed in plan having a working flank, a buttress flank and a curved edge extending from said buttress flank to a corner where said curved edge intersects said working flank, said curved edge being formed as an arc having a center of curvature located vicinal a minor ratchet circle through the inner edges of said working flanks, said center being spaced from said working flank toward said buttress flank along said minor ratchet circle a distance of approximately one-half the radius of said arc.

2. A neck finish according to claim 1 in which said working flank is at an angle alpha to said buttress flank of approximately 60°.

3. A neck finish according to claim 2 in which said buttress flank is at an angle beta to said working flank of approximately 66°.

4. A neck finish according to claim 3 in which a tangent to said curved edge at said corner is at an angle delta to an extension of said working flank greater than 90° and less than 180°.

5. A neck finish according to claim 1 in which said neck ring in vertical cross section has an outer top corner formed curved and an outer bottom corner formed curved in a lesser radius than said outer top corner.

6. A neck finish according to claim 1 in which the first of a series of ratchet teeth comprises a protector having a protector arced surface merging with a buttress flank to deflect an object contacting said protector outwardly, away from said series of ratchet teeth.

7. A neck finish according to claim 6 in which said protector arced surface has a second center of curvature vicinal a circle substantially smaller than said minor ratchet circle.

8. A neck finish according to claim 7 in which said protector arced surface has a second radius of curvature substantially greater than the radius of curvature of said first-mentioned curved edge.

9. A neck finish according to claim 6 which further comprises an intermediate ratchet tooth between said protector and said ratchet teeth, said intermediate ratchet tooth having an intermediate working flank and an intermediate buttress flank and an intermediate curved edge extending from said intermediate buttress flank to a second corner vicinal where said intermediate curved edge intersects said intermediate working flange, said intermediate curved edge being formed as a second arc having a second center of curvature located vicinal a circle about the axis of said neck finish having a diameter less than said minor ratchet arc and said second arc having an intermediate radius substantially greater than the radius of said first-mentioned curved edge.

10. A neck finish according to claim 9 in which said intermediate radius is substantially less than the radius of curvature of said protector.

11. A neck finish according to claim 1 in which further comprises a gripper ring below said ratchet ring and a groove between said gripper ring and said ratchet ring, said gripper ring being of substantially greater diameter than said ratchet ring.

* * * * *